US006406613B1

(12) United States Patent
Nahas et al.

(10) Patent No.: US 6,406,613 B1
(45) Date of Patent: Jun. 18, 2002

(54) MITIGATION OF COKE DEPOSITS IN REFINERY REACTOR UNITS

(75) Inventors: Nicholas Charles Nahas, Chatham, NJ (US); Dean Clise Draemel, Kingwood, TX (US); Richard Edwards Walter, Long Valley; Michael Siskin, Randolph, both of NJ (US); Glen Edward Phillips, Goldvein, VA (US)

(73) Assignee: ExxonMobil Research and Engineering Co., Annandale, NJ (US)

( * ) Notice: Subject to any disclaimer, the term of this patent is extended or adjusted under 35 U.S.C. 154(b) by 0 days.

(21) Appl. No.: 09/685,359

(22) Filed: Oct. 10, 2000

Related U.S. Application Data

(63) Continuation-in-part of application No. 09/438,439, filed on Nov. 12, 1999, now abandoned.

(51) Int. Cl.[7] ..... C10G 9/16

(52) U.S. Cl. ..... 208/48 R; 208/48 Q; 208/48 AA; 585/950

(58) Field of Search ..... 208/48 R, 48 Q, 208/48 AA; 585/950

(56) References Cited

U.S. PATENT DOCUMENTS

| | | | | |
|---|---|---|---|---|
| 2,064,708 | A | 12/1936 | Wilson | 196/47 |
| 2,859,168 | A | 11/1958 | Downing et al. | 208/48 |
| 3,188,184 | A | 6/1965 | Rice et al. | 23/288 |
| 3,365,387 | A | 1/1968 | Harper | 208/48 |
| 3,376,213 | A | 4/1968 | Harper | 208/48 |
| 3,641,190 | A | 2/1972 | Kivlen et al. | 260/683 |
| 3,843,744 | A | 10/1974 | Kramer et al. | 260/679 R |
| 4,022,639 | A | 5/1977 | Ueki | 134/2 |
| 4,043,899 | A | 8/1977 | Anderson et al. | 208/161 |
| 4,276,153 | A | 6/1981 | Yoshitake et al. | 208/48 Q |
| 4,297,150 | A | 10/1981 | Foster et al. | 148/6.3 |
| 4,400,182 | A | 8/1983 | Davies et al. | 48/214 A |
| 4,405,440 | A | 9/1983 | Gwyn | 208/48 Q |
| 4,454,022 | A | 6/1984 | Shoji et al. | 208/48 R |
| 4,816,136 | A | 3/1989 | Allan et al. | 208/127 |
| 4,849,025 | A | 7/1989 | Bain et al. | 134/22.1 |
| 5,015,358 | A | 5/1991 | Reed et al. | 208/48 AA |
| 5,747,401 | A | 5/1998 | Cuif | 501/103 |
| 5,891,584 | A | 4/1999 | Coffinberry | 428/552 |
| 5,972,206 | A | 10/1999 | Lenglet et al. | 208/130 |

FOREIGN PATENT DOCUMENTS

| | | | |
|---|---|---|---|
| EP | 0643122 A2 | 3/1995 | C10G/11/18 |

OTHER PUBLICATIONS

Badini, C.; Saracco, G.; Serra, V.; Specchia, V; "Suitability of some promising soot combustion catalysts for application in diesel exhaust treatment"; Applied Catalysis B: Environmental 1998, 18, pp. 137–150 –no month.

Neeft, J.P.A.; Makkee, M.; Moulijn, J.A.; 1998, 77, 111–119, "Catalytic oxidation of carbon black–I. Activity of catalysts and classification of oxidation profiles"–no month.

*Primary Examiner*—Nadine Preisch
(74) *Attorney, Agent, or Firm*—Estelle C. Bakun; George B. Georgellis

(57) ABSTRACT

A method for mitigating the condensation of liquid hydrocarbons and subsequent coke deposition in refinery reactor units by dew point suppression.

12 Claims, 2 Drawing Sheets

MITIGATION OF COKE DEPOSITS IN REFINERY REACTOR UNITS

This application is a Continuation-in-Part of U.S. Ser. No. 09/438,439 filed Nov. 12, 1999, now abandoned.

FIELD OF THE INVENTION

A preferred embodiment of the invention is directed to mitigating the formation of coke deposits in petroleum refinery reactor units, particularly in the cyclones of fluidized bed coking units (fluid cokers) and reactor overheads of fluid catalytic cracking units.

BACKGROUND OF THE INVENTION

Fluidized bed coking (fluid coking) is a petroleum refining process in which mixtures of heavy petroleum fractions, typically the non-distillable residue (resid) from fractionation, are converted to lighter, more useful products by thermal decomposition (coking) at elevated reaction temperatures, typically about 900 to 1100° F. (about 480 to 590° C.). A large vessel of coke particles maintained at the reaction temperature is fluidized with steam. The feed is heated to a pumpable temperature, mixed with atomizing steam, and fed through a plurality of feed nozzles to the fluidized bed reactor. The light hydrocarbon products of the coking reaction are vaporized, mixed with the fluidizing steam and pass upwardly through the fluidized bed into a dilute phase zone above the dense fluidized bed of coke particles. The transition between the dense bed (dense phase zone) and dilute phase, where product vapor is substantially separated from solid particles, is hereinafter referred to as the phase transition zone. The remainder of the feed liquid coats the coke particles and subsequently decomposes into layers of solid coke and lighter products which evolve as gas or vaporized liquid. The solid coke consists mainly of carbon with lesser amounts of hydrogen, sulfur, nitrogen, and traces of vanadium, nickel, iron, and other elements. The fluidized coke is circulated through a burner, where part of the coke is burned with air to raise its temperature from about 900° F. to about 1300° F. (about 480 to 704° C.), and back to the fluidized bed reaction zone.

The mixture of vaporized hydrocarbon products and steam continues to flow upwardly through the dilute phase at superficial velocities of about 3 to 6 feet per second (about 1 to 2 meters per second), entraining some fine solid particles. Most of the entrained solids are separated from the gas phase by centrifugal force in one or more cyclone separators, and are returned to the dense fluidized bed by gravity. The gas phase undergoes pressure drop and cooling as it passes through the cyclone separators, primarily at the inlet and outlet passages where the velocity is increased. The cooling which accompanies the pressure decrease causes condensation of some liquid which deposits on surfaces of the cyclone inlet and outlet. Because the temperature of the liquid so condensed and deposited is higher than about 900° F. (about 480° C.), coking reactions occur there, leaving solid deposits of coke. Coke deposits also form on the reactor stripper sheds, and other surfaces of the fluid coker reactor.

The mixture of steam and hydrocarbon vapor is subsequently discharged from the cyclone outlet and quenched to about 750° F. (about 400° C.) by contact with downflowing liquid in a scrubber vessel section of the fluid coker equipped with internal sheds to facilitate contacting. A pumparound loop circulates condensed liquid to an external cooling means and back to the top row of scrubber sheds to provide cooling for the quench and condensation of the heaviest fraction of the liquid product. This heavy fraction is typically recycled to extinction by feeding back to the fluidized bed reaction zone, but may be present for several hours in the pool at the bottom of the scrubber vessel and the pumparound loop, allowing time for coke to form and deposit on shed surfaces because of the elevated temperatures.

Feed is injected through nozzles with atomizing steam into the fluidized bed reactor. The feed components not immediately vaporized coat the coke particles and are subsequently decomposed into layers of solid coke and lighter products which evolve as gas or vaporized liquids. During this conversion process some coke particles may become unevenly or too heavily coated with feed and during collision with other coke particles stick together. These agglomerated, now heavier, coke particles may not be efficiently fluidized by the steam injected into the bottom of stripper section and are subsequently carried under from the reactor section to the stripper section where they adhere to and build up on the top rows of sheds in the stripper section. Build up of deposits on the stripper sheds can become so severe due to overlapping of the deposits on adjacent sheds as to restrict fluidization of the coke in the reactor section above and eventually shut the unit down.

Fouling of cyclone outlets and scrubber sheds in a Fluid Coker results in decreased capacity and run length of the unit, culminating in costly unplanned shutdowns. The deposits are sometimes removed from the outlet of the cyclone with metal rods and water jets at high pressure to clear the cyclone outlet area and to keep the unit running. The effectiveness of this approach is temporary and unpredictable. Chunks of coke may fall back into the cyclone body and interfere with cyclone operation. The coke deposits must similarly be removed from the reactor scrubber sheds, reactor walls and other areas of the fluid coker that become fouled. It is well known in the art that providing sufficient cooling of the pumparound loop will minimize fouling of scrubber sheds, but this technique does not affect the cyclone outlet area.

Fluid Catalytic Cracking (FCC) is another petroleum refining conversion process in which heavy oil, typically the highest boiling distillable fraction, is converted to gasoline, diesel and jet fuel, heating oil, liquefied petroleum gas (LPG), chemical feedstocks, and refinery fuel gas by catalytic decomposition at similarly elevated temperatures of about 900 to 1100° F. (about 480 to 590° C.). In a Fluid Catalytic Cracking Unit (FCCU), the heavy oil feed is typically mixed with steam and sprayed into a rising stream of hot (1100 to 1400° F. or about 590 to 760° C.) powdered silica-alumina catalyst. The feed is vaporized by contact with the hot catalyst, and the vapor decomposes catalytically into the desired products within a few seconds, whereupon the solid catalyst particles are separated centrifugally from the vapor by means of cyclone separators or equivalent means. The product vapor passes through the cyclone outlets into a plenum chamber at the top of the reactor, through a discharge nozzle into an overhead line, then to a fractionator where the vapor is quenched and condensed in a zone similar the coker scrubber described above. The separated catalyst is introduced into a stripping zone in which it is further stripped with steam to recover entrained vapor. Because the stripping steam is typically at a significantly lower temperature than the spent catalyst, the catalyst is cooled by the stripping steam to a temperature significantly below the reaction temperature.

Run length or capacity of an FCCU may likewise be limited by deposition of coke in the stripper, reactor overhead, plenum, nozzle, transfer line, or inlet to the fractionator. Coke formation occurs where heat loss allows condensation of heavy hydrocarbons which decompose to form coke. Deposit formation is further aggravated by entrapment of entrained catalyst particles in the condensate. Deposits are most likely to occur where flanges or other heat sinks provide surfaces below the dew point of the product vapor. Deposits may also form at the inlet to the fractionator where expansion cooling of the hot product vapor causes condensation and subsequent coke formation at the entrance to the fractionator. The coke buildup restricts flow and increases pressure drop between the reactor overhead and the fractionator. In units limited by compressor capacity, the pressure drop may be sufficient to limit capacity long before the end of the run, and may ultimately require premature or unplanned shutdown.

In both fluid coking and fluid catalytic cracking units, there is a reaction zone in which the product vapor is in intimate contact with particulate solids, known as the dense phase zone, and a dilute phase zone in which the solids have been substantially separated from the product vapor or where coke and catalyst have disengaged from the dilute (vapor) phase. The mass of solid particles in the reaction zone is many times the mass of the product vapor, and in both types of units the heaviest reaction products condense on the solid particles to form coke. The dew point of the product vapor emerging from the reaction zone (dense phase zone) into the dilute phase zone is essentially the same temperature as the temperature at the transition from the reaction zone (dense phase zone) to the dilute phase zone known as the phase transition temperature. In many FCCU's the reaction zone is terminated by cyclone separators, and the dilute phase is the zone into which the cyclone outlets discharge, typically a plenum at the top of the vessel housing the cyclones.

What is needed in the art is an efficient, predictable, and effective way to mitigate the formation of detrimental coke deposits in the dilute phase overhead equipment such as fluid coker cyclones and accompanying surfaces and in the overhead dilute phase zone, plenum, discharge nozzle and overhead lines of fluid catalytic cracking units to avoid loss of capacity and expensive shutdowns.

SUMMARY OF THE INVENTION

An embodiment of the present invention is a method for mitigating the condensation of liquid hydrocarbons and subsequent coke formation at temperatures in the range of about 700° F. to 1100° F. (about 370° C. to 590° C.) in the dilute phase zones of fluid cokers and FCCU's such as occurs in overhead equipment.

An embodiment of the invention is directed to a method for mitigating the condensation of liquid hydrocarbons and subsequent coke deposition in refinery reactor units wherein during operation of said units a dense phase zone comprising hydrocarbon feed and a dilute phase zone comprising vaporized hydrocarbon products produced from said hydrocarbon feed and a phase transition zone between said dense and dilute phase zones are present, said method comprising injecting a non-condensable medium wherein said medium is selected from the group consisting of non-condensable vapors, gases, and mixtures thereof into said dilute phase zone, to form an admixture with said vaporized hydrocarbon products wherein the dew point of the dilute phase zone is suppressed while maintaining the temperature above the suppressed dew point and wherein said dew point of said dilute phase zone will be suppressed by at least about 5° F. (about 3° C.) below the temperature of said dilute phase zone.

Practice of the invention comprises introducing a stream of gas or vapor, typically steam, but non-condensable at temperatures above about 705° F. (about 374° C.) into the dilute phase zone to form an admixture with the product hydrocarbon vapor.

DETAILED DESCRIPTION OF THE INVENTION

Figure 1:
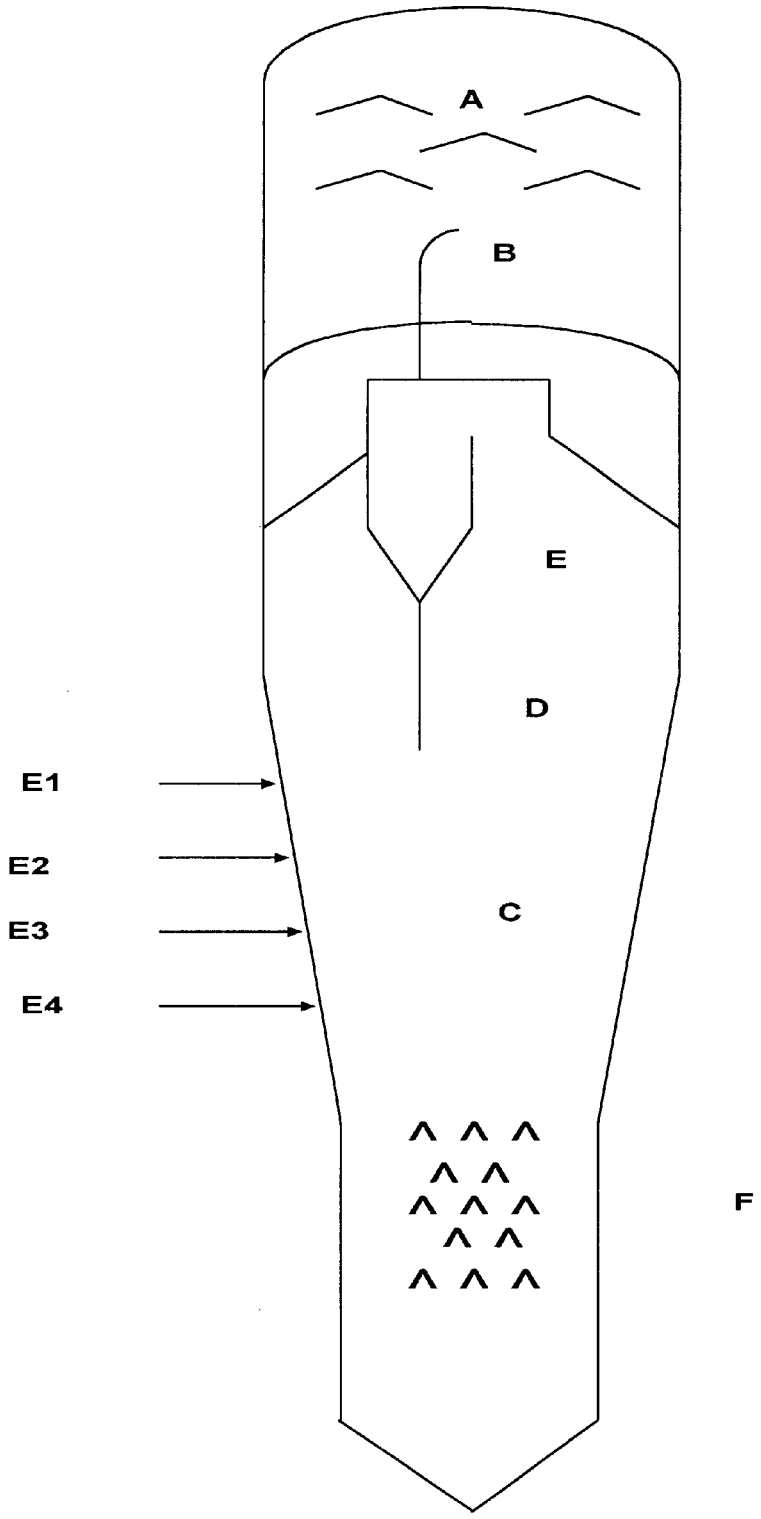
FIG. 1 depicts a typical fluid coking unit. A are scrubber sheds, B the cyclone outlet, C, D, and E are the dense phase reaction zone, phase transition zone, and dilute phase reaction zone, respectively. $E_1$, $E_2$, $E_3$, $E_4$ are feed injection ports, and F are stripper sheds.
Figure 2:
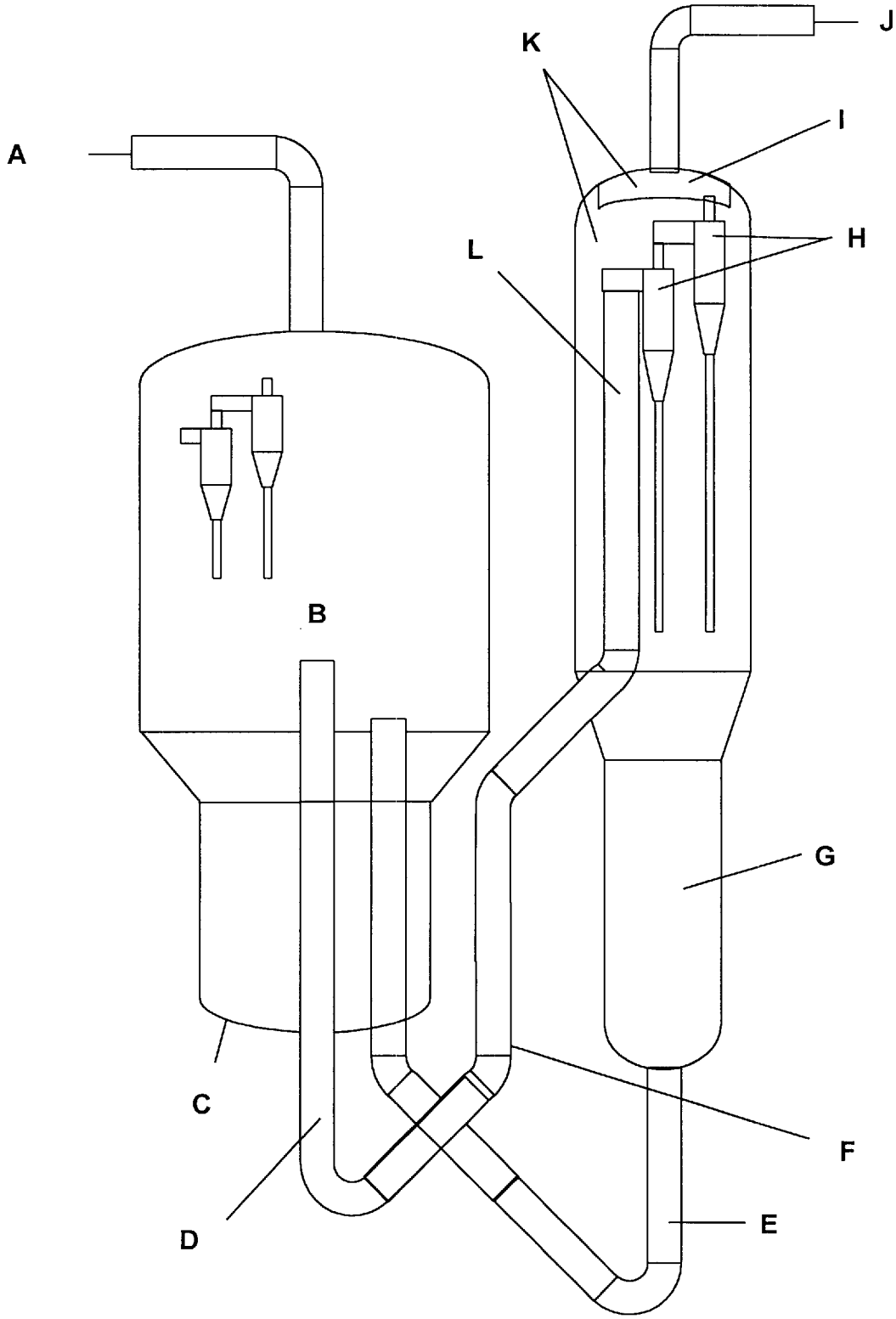
FIG. 2 depicts a typical FCCU. A=flue gas outlet, B=regenerator, C=air injection, D=regenerated catalyst standpipe, E=spent catalyst standpipe, F=feed, G=stripper, H=cyclone separators, I=plenum, J=Product Vapor outlet, K=dilute phase zone, and L=dense phase reaction zone.

It has been found that formation of coke proceeds within a few hours in the condensed liquid phase at temperatures above about 700° F. (about 370° C.) but very slowly in the gas or vapor phases even at significantly higher temperatures than are encounted in fluid coking or fluid catalytic cracking. It has further been found that the dew point of the mixture of fluidizing steam and hydrocarbon product vapors in the dilute phase of both fluid cokers and fluid catalytic cracking units is the temperature of the phase transition zone from the dense phase to the dilute phase.

Applicants have discovered that by injecting a non-condensable vapor and/or gas into the dilute phase zone, the dew point of the admixture so produced by the medium and dilute phase will be below the pre-injection temperature of the dilute phase, and condensation and, hence, coke deposition, will thereby be prevented. Thus, the non-condensable medium is a medium that is non-condensable at temperatures greater than or equal to 705° F. (374° C.). The non-condensable medium will be injected under conditions sufficient to prevent cooling of the product vapor in the transition phase zone and to maintain or raise the temperature of the product vapors in the phase transition zone about 1 to about 20° F. (about 0.6° C. to about 11° C.) above that of the phase transition zone. The non-condensable medium may itself serve to prevent cooling of the product vapor by maintaining or raising its temperature, or another means may be utilized.

An embodiment of the invention is directed to a method to mitigate the formation of coke deposits formed in refinery units such as fluid coker units and fluid catalytic cracking units during operation of said units, wherein said units have a reaction zone in which the product vapor is in intimate contact with a mass of solid particles such as coke or catalyst, said mass of solid particles being substantially greater than the mass of said product vapor, and a dilute phase zone in which said product vapor has been substantially separated from said solid particles in the reaction zone. The method comprises mitigating the formation of coke deposits in such refinery units, by injecting a gas or vapor such as steam into the dilute phase zone of the said reactor unit, said gas or vapor being at a temperature at least about equal to the temperature of said phase transition zone at the transition between the dense phase zone and the dilute phase zone, wherein said gas or vapor is non-condensable at temperatures above about 705° F. (about 374° C.), and wherein said gas or vapor is injected in an amount and at a temperature sufficient to lower the dew point of said dilute phase zone while maintaining the temperature of said dilute phase zone above said lowered dew point. Typically, it will be desirable for the dew point of the admixture of non-condensable medium and dilute phase to be at least about 10° F. (6° C.) less than the temperature of the dilute phase post injection. Any temperature difference between the dew point and dilute phase post injection of non-condensable medium will suffice, preferably a difference of at least about 5° F. (difference of about 3° C.), more preferably at least about 10° F. (difference of about 6° C.) will be used. The above operation is carried out continuously during normal operation of the refinery units.

Preferably, the non-condensable medium will be injected into the dilute phase zone of the reactor at a temperature higher than the temperature of the phase transition zone, hereinafter called the phase transition temperature. Otherwise, there is a risk that the cooling of the product vapor, already at its dew point, will cause the condensation of liquid which it is intended to prevent. Preferably, the temperature will be at least about 1 to about 100° F., (about 0.6 to about 55° C.) above the phase transition temperature and, more preferably, about 10 to about 50° F. (6 to about 28° C.) higher than the phase transition temperature. Lower temperatures than the preferred ranges will be less effective against downstream cooling effects, and higher temperatures will increase thermal decomposition of product components to less valuable constituents. Preferably, the temperature will be such that the temperature will maintain the temperature at the cyclone outlet at least about 5° F. (at least about 3° C. higher) higher than the phase transition temperature.

During operation of a fluid coker, for example, coke is laid down in several areas of the cyclone and also in the scrubber section. Areas such as the cyclone outlet are of particular concern since the deposited coke can restrict flow ultimately requiring system shutdown. Likewise, in the operation of a fluidized catalytic cracking unit, the product vapor at its dew point is introduced into the larger cross-sectional area of the fractionator, and the accompanying expansion cooling can be sufficient to condense droplets of liquid, some of which adhere to the entrance opening, where the liquid is held at elevated temperatures sufficient to cause formation of coke deposits. The buildup of coke restricts flow and decreases capacity.

An embodiment of the method offers a cost effective and efficient way to prevent coke deposits that form in refinery units such as fluid cokers (FC) and fluid catalytic cracking units (FCCU) to facilitate longer run times and to maintain throughput. Effective mitigation of coke deposits in areas of the units such as the cyclone and cyclone outlet of a FC unit and the stripper, reactor overhead, plenum, nozzle transfer line or fractionator inlet of FCCU is achieved.

The coke deposit mitigation taught herein recognizes that coke deposits form when products are condensed or in the liquid phase. Coke deposits form at a substantially slower rate when the reactor products are in the gaseous phase. Thus, by maintaining the reaction products produced in refinery units in the gaseous phase in the dilute phase zone, prior to quenching, coke deposition can be easily mitigated thus preventing coke deposits from forming on reactor surfaces that can become plugged necessitating unit shutdowns.

The invention involves suppressing the dew point of the dilute phase of the reactor products while maintaining the temperature above the reduced dew point. To accomplish this, a non-condensable medium which may also be referred to as a diluent medium is injected into the dilute phase zone of the reactor unit. Typically, the amount of non-condensable medium injected will be that amount necessary to cause the dew point of the dilute phase zone to be at least about 10° F. (about 6° C.) below the temperature of the dilute phase zone. Typically, at least about 5 mole % non-condensable medium will be injected. Non-condensable mediums can be selected from, for example, steam, recycled hydrocarbon, inert gases and mixtures thereof. The term non-condensable as used herein means that the medium will be a gas or a vapor at temperatures above about 705° F. (about 374° C.). Though the non-condensable medium can be used to maintain or raise the temperature of the product vapors in the phase transition zone other methods may also be employed. Any alternative means which can accomplish this will suffice and may be used alone or in combination with the non-condensable medium being employed to raise the temperature of the product vapor. For example, scouring coke can be injected into the unit to maintain or raise the temperature of the product vapors. Other means known to the skilled artisan could also be employed.

As used herein, the dilute phase, the transition phase and dense phase occupy the dilute phase zone, phase transition reaction zone, and dense phase reaction zone, respectively. Thus, injection of the non-condensable medium into the dilute phase zone necessarily means injecting the medium into the dilute phase. Those skilled in the art readily appreciate such terminology and its interchangeability.

The preferred amount of non-condensable medium will normally range from about 1% to about 50% by volume of the product vapor and, more preferably from about 5% to about 20% by volume. Lesser amounts than the preferred ranges will be less effective at reducing the dew point, and greater amounts than the preferred ranges will be more costly to provide and subsequently separate from the desired commercial products.

Preferably, in a fluid coker, the non-condensable medium will be introduced into the dilute phase zone above the top of the dense bed and below the cyclone inlets.

Preferably, in an FCCU, the non-condensable medium will be introduced into the plenum of the vessel housing the reactor cyclones, into which plenum the reaction products are discharged from the cyclone outlets. Alternatively, the non-condensable medium may be introduced anywhere downstream of the primary cyclone outlet. If the unit configuration allows the stripping gas from the spent catalyst stripper to mix with the product vapor between the primary and secondary cyclones, the non-condensable medium may be introduced into the stripper as long as the spent catalyst is not cooled in the stripper as is typical in the current state of the art practice. If recycled hydrocarbon is to be utilized as the non-condensable medium introduced to the stripper, it is preferable to inject it into the dilute phase zone of the stripper to minimize hydrocarbon carryunder to the regenerator.

In the course of performing the instant invention, one skilled in the art can easily monitor with existing or installed thermocouples the temperature of the dense phase zone, the phase transition zone, or the dilute phase zone. It is preferable that the products, immediately prior to being quenched, are at a temperature above that of the phase transition zone. Preferably, they will be at a temperature at least about 1 to about 20° F. (about 0.6 to about 11° C.) and, more preferably, about 2 to about 10° F. (about 1 to 6° C.) higher than the phase transition zone or the phase transition temperature. Maintaining this higher temperature ensures that product vapor is above its dew point and minimizes the risk of liquid condensation and subsequent formation of coke deposits. Preferably, the non-condensable medium, when used to prevent the product vapor from cooling, will be of a temperature when injected such that it maintains the temperature of the reactor cyclone outlet products at a temperature of at least about 1 to about 20° F. (0.6 to about 11° C.) higher than the temperature of the phase transition zone.

In the case of an FCCU, it is preferable that the non-condensable medium be injected at a temperature such that it maintains the temperature of the product vapor at the plenum outlet or the temperature of the fractionator inlet at least about 10° F. (6° C.) higher than the temperature of the riser outlet.

One skilled in the art will readily recognize that the non-condensable medium can be injected into the dilute phase zone of the FCCU by injecting into the cyclone outlet plenum chamber, the product line upstream of the fractionator inlet or in some configurations the catalyst stripper where steam stripping occurs.

What is claimed is:

1. A method for mitigating the condensation of liquid hydrocarbons and subsequent coke deposition in refinery reactor units wherein during operation of said units a dense phase zone comprising hydrocarbon feed and a dilute phase zone comprising vaporized hydrocarbon products produced from said hydrocarbon feed and a phase transition zone between said dense and dilute phase zones are present, said method comprising injecting a non-condensable medium wherein said medium is selected from the group consisting of non-condensable vapors, gases, and mixtures thereof, into said dilute phase zone, to form an admixture with said vaporized hydrocarbon products wherein the dew point of the dilute phase zone is suppressed while maintaining the temperature above the suppressed dew point and wherein said dew point of said dilute phase zone will be suppressed by at least about 5° F. below the temperature of said dilute phase zone.

2. The method of claim 1 wherein said non-condensable medium is non-condensable at temperatures greater than or equal to 705° F.

3. The method of claim 1 wherein said non-condensable medium is selected from the group consisting of steam, hydrocarbons, inert gases and mixtures thereof.

4. The method of claim 1 wherein said refinery unit is a fluid coking unit or a FLEXICOKING unit.

5. The method of claim 1 wherein said refinery unit is a fluid catalytic cracking unit.

6. The method of claim 1 wherein said non-condensable medium is injected at a temperature at least about 1 to about 100° F. higher than the phase transition zone.

7. The method of claim 1 wherein at least about 5 mole % of non-condensable medium is injected.

8. The method of claim 4 wherein the fluid coking unit includes a cyclone having a cyclone inlet and a cyclone outlet and wherein the temperature of said non-condensable medium is selected to maintain the temperature of the reactor cyclone outlet at least about 5° F. higher than the phase transition temperature.

9. The method of claim 4 wherein the non-condensable medium is introduced into the dilute phase zone below the fluid coking unit cyclone inlet.

10. The method of claim 4 wherein the fluid coking unit includes a cyclone having a cyclone inlet and a cyclone outlet and wherein the temperature of said non-condensable medium is selected to maintain the temperature of the reactor cyclone outlet at least about 10° F. higher than the phase transition temperature.

11. The method of claim 5 wherein the fluid catalytic cracking unit includes cyclone outlets discharging into a plenum and the non-condensable medium is introduced into the plenum below the fluid catalytic cracking unit cyclone outlets.

12. The method of claim 1 wherein said phase transition zone contains product vapors and wherein said non-condensable medium, scouring coke or a mixture thereof is injected at a temperature sufficient to maintain or raise the temperature of said product vapors in said phase transition zone at least about 1.0 to about 20° F. above the phase transition zone temperature.

* * * * *